US012134946B2

(12) United States Patent
Morris et al.

(10) Patent No.: US 12,134,946 B2
(45) Date of Patent: Nov. 5, 2024

(54) WELLBORE PRODUCTION METHOD AND SYSTEM USING BAILER

(71) Applicant: OPTIMIZED INTEGRATED LIFT SYSTEMS LLC, W. Aledo, TX (US)

(72) Inventors: John Rickey Morris, Lloydminster (CA); Collin Rickey Morris, Lloydminster (CA); Sheldon Michael Minish, Lloydminster (CA)

(73) Assignee: Optimized Integrated Lift Systems LLC

( * ) Notice: Subject to any disclaimer, the term of this patent is extended or adjusted under 35 U.S.C. 154(b) by 188 days.

(21) Appl. No.: 17/642,100

(22) PCT Filed: Aug. 21, 2020

(86) PCT No.: PCT/CA2020/051139

§ 371 (c)(1),
(2) Date: Mar. 10, 2022

(87) PCT Pub. No.: WO2021/046633

PCT Pub. Date: Mar. 18, 2021

(65) Prior Publication Data

US 2022/0372826 A1 Nov. 24, 2022

Related U.S. Application Data

(60) Provisional application No. 62/899,281, filed on Sep. 12, 2019.

(51) Int. Cl.
*E21B 27/00* (2006.01)
*E21B 19/00* (2006.01)
(Continued)

(52) U.S. Cl.
CPC ..... *E21B 27/00* (2013.01); *E21B 19/008* (2013.01); *E21B 33/10* (2013.01); *E21B 34/08* (2013.01); *E21B 43/121* (2013.01)

(58) Field of Classification Search
CPC ..... E21B 19/008; E21B 27/00; E21B 33/10; E21B 34/08; E21B 43/121; E21B 43/126; F04B 47/02
See application file for complete search history.

(56) References Cited

U.S. PATENT DOCUMENTS 760,570 A * 5/1904 Schellhammer ..... E21B 27/00 294/68.25
864,229 A * 8/1907 Carroll ..... E04G 21/025 414/616

(Continued)

FOREIGN PATENT DOCUMENTS

WO WO-02064941 A1 * 8/2002 ..... E21B 27/00

*Primary Examiner* — Daniel P Stephenson
(74) *Attorney, Agent, or Firm* — Ryan W. Dupuis; Michael R. Williams; Ade & Company Inc.

(57) ABSTRACT

Hydrocarbons are produced from a wellbore using a wand member supported within the top end of the casing and a bailer vessel supported within the casing of the wellbore to reciprocate between (i) a lower position submerged in the hydrocarbon fluids at a predetermined depth within the casing such that fluids enter a production chamber of the bailer vessel and (ii) an upper position receiving the wand member therein through an open top of the bailer vessel so as to force the hydrocarbon fluids in the production chamber under pressure through a bottom opening in the wand member and into a receiving chamber of the wand member. The hydrocarbons in the wand member are then discharged to a location externally of the casing for storage.

18 Claims, 1 Drawing Sheet

(51) Int. Cl.

| | |
|---|---|
| ***E21B 33/10*** | (2006.01) |
| ***E21B 34/08*** | (2006.01) |
| ***E21B 43/12*** | (2006.01) |

(56) References Cited

U.S. PATENT DOCUMENTS 1,607,513 A * 11/1926 Cline ..... E21B 27/00 294/68.25
1,612,062 A * 12/1926 Scott ..... E21B 27/00 175/395
3,089,544 A 5/1963 Cobb
3,780,804 A * 12/1973 Pagel ..... E21B 27/00 166/162
4,037,662 A 7/1977 Bowling
5,054,557 A * 10/1991 Wittrisch ..... E21B 47/06 166/309
6,039,544 A 3/2000 Strickland
6,089,322 A * 7/2000 Kelley ..... E21B 43/38 166/372
6,099,274 A * 8/2000 Conn ..... F04B 53/143 92/158
6,464,012 B1 10/2002 Strickland
2003/0034161 A1* 2/2003 Rice ..... F04B 49/065 417/36
2009/0266534 A1* 10/2009 Arlandis ..... E21B 43/126 166/68.5
2010/0163245 A1* 7/2010 Alvarado Vargas .... E21B 27/00 166/69
2012/0090851 A1* 4/2012 Irwin, Jr. ..... E21B 43/121 166/107
2014/0262299 A1* 9/2014 Tinnen ..... E21B 27/00 166/107
2022/0372826 A1* 11/2022 Morris ..... F04B 47/02
2023/0203924 A1* 6/2023 Arlandis ..... E21B 43/121 166/216

* cited by examiner

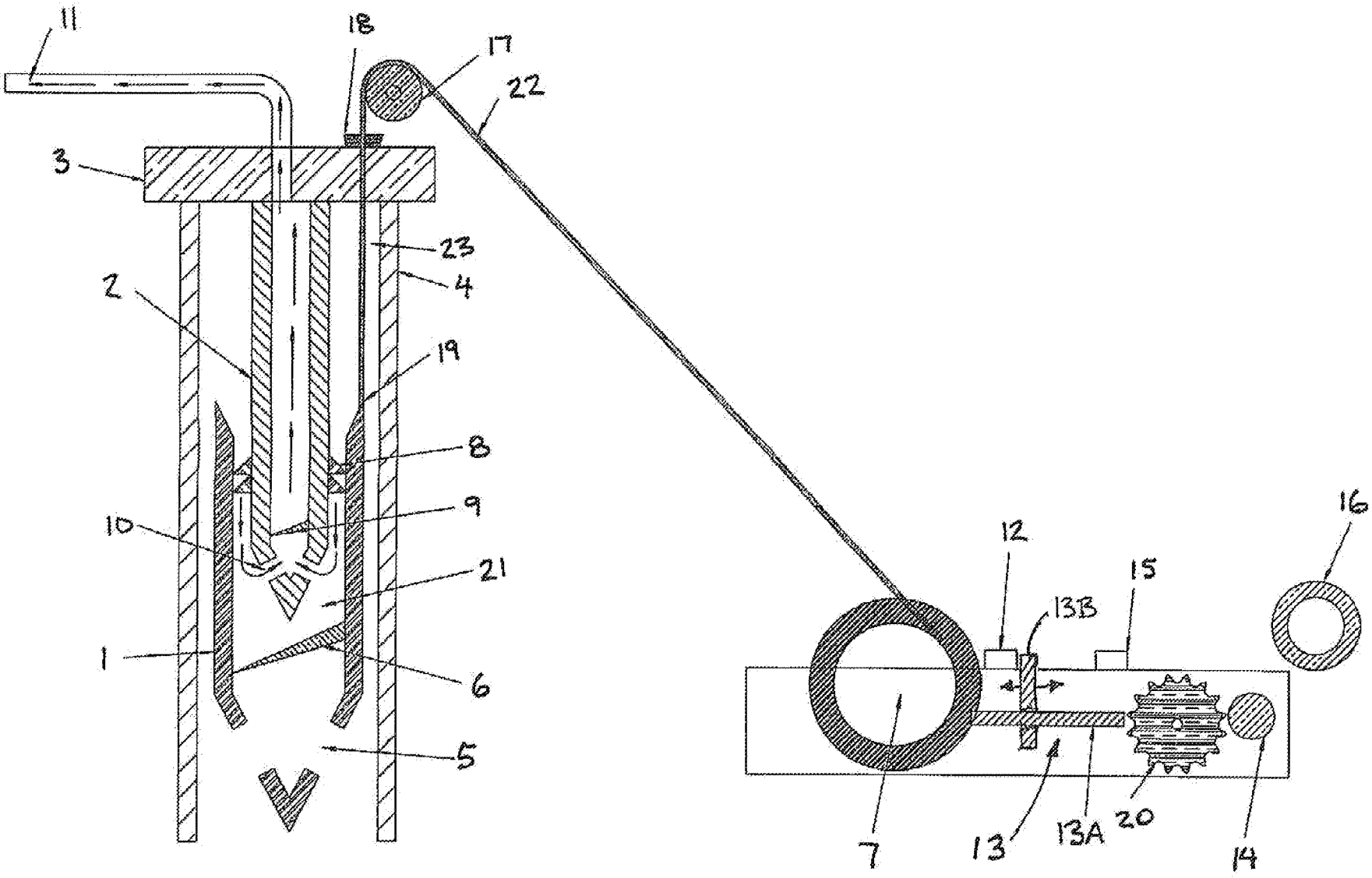
16
14
15
20
13A
13B
12
13
7
22
17
18
23
4
19
8
9
21
6
5
11
3
2
10
1

WELLBORE PRODUCTION METHOD AND SYSTEM USING BAILER

FIELD OF THE INVENTION

The present invention relation to a method of producing hydrocarbons from a wellbore using a bailer vessel which can be filled by being submerged within hydrocarbons in a lower portion of the wellbore and which is emptied at a top of the wellbore.

BACKGROUND

In many instances, the economic feasibility of conventional means of pumping oil, such as sucker rods, centrifugal pumps, PCPs, and rotating pumps may be cost prohibitive for some wellbores of limited producing ranges or questionable casing integrity.

Bailers used a bucket-type vessel to remove sand, mud or other substances or fluids in a wellbore or borehole require above grade enclosures to use gravity to dispel said substance or fluid delivered to surface by the "bailer". Examples include U.S. Pat. No. 760,570 by Schellhammer, U.S. Pat. No. 3,780,804 by Pagel, U.S. Pat. No. 864,229 by Carroll, U.S. Pat. No. 1,612,062 by Scott and U.S. Pat. No. 1,607,513 by Cline. In each instance, the requirement to use gravity to dispel the contents of the bailer requires considerable apparatus to accomplish and substantial cost and manpower to maintain and operate.

SUMMARY OF THE INVENTION

It is the object of this invention to provide a low cost, low maintenance, low energy solution to autonomously produce problematic or low yielding wellbores to surface using a bailer undersized to fit with room to spare in the wellbore. This will not limit the use in any wellbore, regardless of well statistics.

The present invention provides a well bailer with a "sleeve" or "barrel" to facilitate well fluid to be elevated and evacuated to surface as produced fluid to a storage device or pipelines, etc.

According to one aspect of the invention there is provided a wellbore production system for use with a wellbore having a casing containing hydrocarbon fluids, the system comprising:

a bailer vessel arranged to be received in the casing of the wellbore so as to be movable longitudinally along the casing between an upper position in proximity to a top end of the casing and a lower position arranged to be submerged in the hydrocarbon fluids at a predetermined depth within the casing;

the bailer vessel comprising (i) a production chamber, (ii) at least one bottom opening in communication with a bottom of the production chamber and arranged to receive the hydrocarbon fluids into the production chamber therethrough in the lower position of the bailer vessel, (iii) a bailer valve associated with said at least one bottom opening so as to be arranged to restrict removal of fluids from the production chamber through the at least one bottom opening when the bailer vessel is not in the lower position, and (iv) a top opening in communication with a top of the production chamber;

a lift assembly operatively connected to the bailer vessel through the top end of the casing and arranged to displace the bailer vessel between the upper position and the lower position thereof;

a wand member arranged to be supported within the casing in proximity to the top end of the casing such that a bottom end of the wand member is arranged to be received into the production chamber through the top opening of the bailer vessel in the upper position of the bailer vessel;

the wand member including (i) a receiving chamber, (ii) at least one bottom opening in communication with a bottom of the receiving chamber and arranged to receive the hydrocarbon fluids into the receiving chamber therethrough as the bailer vessel approaches the upper position and receives the bottom end of the wand member therein, (iii) a wand valve associated with said at least one bottom opening so as to be arranged to restrict removal of fluids from the receiving chamber through the at least one bottom opening when the bailer vessel is not in the upper position, and (iv) an outlet opening in communication with the receiving chamber; and an outlet passage arranged to communicate from the outlet opening of the wand member to a discharge location externally of the casing.

According to a second aspect of the present invention there is provided a method of producing hydrocarbon fluids from a wellbore having a casing containing hydrocarbon fluids, the method comprising:

providing a wand member within the casing in a proximity to a top end of the casing, in which the wand member includes (i) a receiving chamber therein, (ii) at least one bottom opening in communication with the receiving chamber, and (iii) an outlet opening in communication with the receiving chamber;

providing a bailer vessel within the casing, in which the bailer vessel includes (i) a production chamber, and (ii) a top opening in communication with a top of the production chamber;

supporting the bailer vessel within the casing to be reciprocated between (i) a lower position submerged in the hydrocarbon fluids at a predetermined depth within the casing such that hydrocarbon fluids enter the production chamber and (ii) an upper position in which the wand member is received in the top opening of the bailer vessel so as to force the hydrocarbon fluids in the production chamber under pressure through said at least one bottom opening in the wand member into the receiving chamber of the wand member; and discharging the hydrocarbons in the receiving chamber of the wand member to a discharge location externally of the casing.

Preferably the system further includes a sealing interface between the wand member and the bailer vessel which seals the top of the production chamber in the bailer vessel closed when the wand member is received within the bailer vessel, in which the sealing interface is arranged to maintain a seal between the wand member and the bailer vessel throughout relative sliding movement between the wand member and the bailer vessel when the bailer vessel is in proximity to the upper position.

Preferably a contained volume of the production chamber between the bailer valve therebelow and the sealing interface thereabove is reduced as the bailer vessel approaches the upper position to force the hydrocarbons in the production chamber of the bailer vessel to enter the at least one bottom opening of the wand member under pressure.

The sealing interface may comprise a sealing member fixedly supported on an exterior of the wand member so as to be slidable along an interior surface of the bailer vessel as the bailer vessel approaches the upper position. Preferably the sealing member is supported in proximity to the bottom of the receiving chamber above said at least one bottom opening in the wand member.

The bailer valve may comprise a check valve which only allows hydrocarbon fluids to enter the production chamber through the at least one bottom opening of the bailer vessel.

The wand valve may comprise a check valve which only allows hydrocarbon fluids to enter the receiving chamber through the at least one bottom opening of the wand member.

The bailer vessel preferably includes a bottom end which is tapered downwardly and inwardly towards a pointed apex.

Preferably the at least one bottom opening in the bailer vessel is a plurality of bottom openings.

When a bottom end of the bailer vessel is tapered downwardly and inwardly towards a pointed apex, preferably the bottom openings are circumferentially spaced apart about the pointed apex.

The bailer valve may comprise a single valve operatively connected to the plurality of bottom openings of the bailer vessel.

Preferably the at least one bottom opening in the wand member comprises a plurality of bottom openings. When a bottom end of the wand member is tapered downwardly and inwardly towards a pointed apex, preferably the bottom openings of the wand member are circumferentially spaced apart about the pointed apex of the wand member.

The wand valve may comprise a single valve operatively connected to the plurality of bottom openings of the wand member.

When the system includes a wellhead enclosing a top end of the casing, the outlet passage preferably communicates externally of the casing through the wellhead.

The lift assembly may comprise a winch assembly having a winch cable communicating into the casing through a cable stripper mounted in the wellhead.

Preferably the winch cable communicates through the wellhead at an offset location adjacent a periphery of the casing and attaches to the bailer vessel offset to one side of the bailer vessel.

When the lift assembly comprises a winch assembly suspending the bailer vessel from a winch cable, the winch assembly is preferably arranged to lower the bailer vessel from the upper position to the lower position under force of gravity using hydraulic restriction to limit rate of decent of the bailer vessel within the casing.

The lift assembly preferably includes a drive assembly that is operable in a lifting mode to raise the bailer vessel up to the upper position and in a lowering mode to lower the bailer vessel down to the lower portion. In this instance, the drive assembly preferably comprises:

(a) a screw rod which is (i) rotated in a first direction of rotation in the lifting mode and (ii) rotated in an opposing second direction of rotation in the lowering mode;

(b) a follower element operatively connected to the screw rod such that the follower element is (i) displaced along the screw rod in a first direction when the screw rod is rotated in the first direction of rotation and (ii) displaced along the screw rod in an opposing second direction when the screw rod is rotated in an opposing second direction of rotation corresponding to lowering of the bailer vessel within the casing;

(c) an upper limit switch arranged to be actuated by the follower element when the bailer vessel reaches the upper position and which is operable to switch operation of the drive assembly from the lifting mode to the lowering mode; and (d) a lower limit switch arranged to be actuated by the follower element when the bailer vessel reaches the lower position and which is operable to switch operation of the drive assembly from the lowering mode to the lifting mode.

BRIEF DESCRIPTION OF THE DRAWINGS

One embodiment of the invention will now be described in conjunction with the accompanying drawings in which:

FIG. 1 is a schematic representation of the production system according to the present invention.

In the drawings like characters of reference indicate corresponding parts in the different figures.

DETAILED DESCRIPTION

With reference to FIG. 1, simply stated, this invention consists of a bailer pipe 1 and stationary wand 2 The wand is fastened to the wellhead 3 and is stationary concentric to the internal well casing 4. The bailer falls to a predetermined level within the wellbore. The bottom of the bailer has slots 5 to allow fluid to enter the bailer chamber and is held therein by bailer check valve 6 above the slotted inlet. The bailer is then brought to surface by the winch assembly 7 and passes concentrically over the wand as the bailer is brought upwards in the wellbore. There are wand v-seals 8 situated toward the lowest end of the wand and above the wand check valve 9 with open slots 10 to allow fluid carried to surface by the bailer to be forced into the wand. On subsequent trips this will cause fluids in the wand to evacuate produced fluids to storage/11. The bailer causes the upper limit switch 12 in the control module 13 to disconnect the clutch 14 and the bailer 1 falls back to a predetermined depth in the wellbore which actuates the lower limit switch 15 in the control module 13 to a begin another cycle back to the surface.

Check valves 6 and 9 in the bailer and the wand 2 prevent backflow and captures fluids 21 each cycle.

According to this aspect of the present invention, there is a drum winch assembly 7 actuated by a transmission 20 which is powered by an electric clutch 14 driven by an electric motor 16 to cause the lifting or take-up of the wire rope defining a winch cable 22 which passes over a wellhead pulley 17 attached to the wellhead through a mechanical stripper element 18 and into the wellbore 23 where it is fastened to the bailer 1 by means of an offset rope socket cable tie system 19. The wire rope that defines the winch cable 22 is played out and the bailer 1 is lowered under its own weight with hydraulic control of the speed of descent at the control module 13 of the winch 7 to the required, predetermined depth in the wellbore. When the predetermined depth is reached the lower limit switch 15 in the control module 13 of the winch assembly 7 is activated to turn power on to the electric clutch 14 to again cycle to surface.

The invention may include means to prevent excessive strain on cable, winch, transmission and motor.

Winch cable 22 slack will not be present as the spear design of the bailer will continue downward after contacting fluid which immediately opens bailer check valve and the downward weight is the only factor which plays out the winch cable 22. The bailer 1 is under full control during descent by means of a hydraulic restriction in the transmission of the winch 7 and control module 13.

As described herein, the present invention relates to a wellbore production system for producing hydrocarbon fluids from a wellbore 23 having a casing 4 which lines the wellbore and which is in open communication with a hydrocarbon formation so as to receive hydrocarbon fluids therein from the formation. The casing 4 is typically enclosed at a top end at surface or above ground by a wellhead including a well casing flange 3.

The wellbore production system generally includes a bailer vessel 1 supported for reciprocating movement between an upper position in proximity to a top end of the casing and a lower position arranged to be submerged in the hydrocarbon fluids in the casing at a predetermined depth within the casing.

The bailer vessel 1 has a cylindrical body in the form of a hollow tube with an outer diameter which is less than the inner diameter of the casing 4 so as to allow the vessel to be readily received within the casing for movement between the upper position and the lower position respectively. The cylindrical body of the vessel tapers downwardly and inwardly at a bottom end portion forming a cone which tapers inwardly towards an apex at the bottom of the vessel.

The opposing top end of the vessel remains open by a top opening which fully spans the top end of the body. The resulting top opening is generally circular in shape. The cylindrical wall forming the main portion of the body of the vessel 1 is tapered at the upper edge thereof such that the top opening has a mouth which is tapered at a slope extending upward and radially outward from the inner diameter of the main body therebelow to the outer diameter of the body at the top and of the vessel.

A plurality of bottom openings 5 are provided at circumferentially spaced locations within the bottom end portion that is conical in shape so that the bottom openings are spaced apart about the apex at the bottom of the bailer vessel. The bottom openings communicate from the exterior of the vessel to a common entry chamber located within the interior of the bottom cone portion of the vessel.

A bailer check valve 6 is supported internally within the vessel 1 at the bottom of the main body portion, directly above the common entry chamber within the hollow cone below. The check valve 6 controls flow of fluids entering the bottom openings 5 into the entry chamber therebelow relative to the remainder of the hollow interior above the valve 6 which is defined within the interior of the main cylindrical body of the vessel as a production chamber. The check valve 6 is a one-way flap valve which only opens to allow upward flow therethrough when pressure below the valve within the entry chamber exceeds pressure above the valve within the production chamber.

A lift assembly is provided in the form of a winch assembly 7 having a drum which winds a winch cable 22 thereon to raise the vessel and which deploys the winch cable 22 therefrom to lower the vessel. The winch assembly further includes a top pulley 17 supported above the wellhead such that the winch cable 22 passes over the pulley 17 from the drum located externally of the casing at a location offset to one side of the casing to the interior of the casing through a corresponding passage extending through the top flange of the wellhead 3. A suitable stripper member 18 is supported on the top flange of the wellhead 3 to receive the winch cable 22 therethrough while wiping the cable 22 clean as it exits the wellbore casing for winding onto the drum.

The end of the winch cable 22 received within the wellbore is connected to the vessel 1 using an offset connector 19 which is joined to the peripheral wall of the vessel 1 at an offset location to one side of the vessel. In this manner the winch cable 22 does not interfere with or obstruct the open top opening at the top end of the vessel 1.

A drive assembly is used to drive rotation of the winch assembly 7 and includes a motor 16 to supply an input rotation. A clutch 14 selectively engages and disengages the motor 16 with the drum that winds the winch cable 22 thereon according to a selected mode of the lift assembly. When the clutch 14 is engaged in a lifting mode, a transmission 20 transfers drive from the electric motor 16 to a control module 13 having a driveshaft which in turn transmits the input rotation to the drum of the winch assembly. The driveshaft of the control module 13 comprises screw rod 13A in the form of a rod which is externally threaded. The screw rod 13A supports a follower element 13B thereon in the forms of a threaded nut which is threaded onto the screw rod of the control module 13 such that the follower element is displaced linearly along the screw rod as the screw rod is rotated.

In the lifting mode of operation, corresponding to the clutch 14 being engaged, the motor drives rotation of the screw rod 13A in a first direction of rotation corresponding to rotation of the drum for winding the cable onto the drum which in turn raises the vessel 1 within the casing towards the upper position. When the screw rod 13A is rotated in the first direction of rotation, the follower 13B moves linearly in a corresponding first direction until the follower element engages an upper limit switch 12 at one end of the screw rod which corresponds to the bailor vessel 1 reaching the upper position at the top of the casing. The upper limit switch 12 functions to switch the mode into a lowering mode of operation primarily by disengagement of the clutch 14.

In the lowering mode of operation, the clutch is disengaged so that the motor is disengaged from the drum. Gravity acting on the vessel 1 lowers the vessel and deploys the cable 22 from the drum of the winch assembly. This causes the screw rod to be rotated in an opposing second direction of rotation while the vessel is lowered within the casing towards the lower position. This acts to displace the follower element in a second linear direction along the screw rod until the follower element engages a lower limit switch 15 at the opposing end of the screw rod which corresponds to the vessel reaching the lower position within the casing of the wellbore. The transmission 20 remains engaged with the drum of the winch assembly through the control module 13 despite the clutch disengaging the electric motor from the transmission. The transmission is a hydraulic transmission having a hydraulic restriction which provides a braking effect which limits the rate of descent of the vessel within the wellbore casing in a controllable manner in the lowering mode.

Once the lower limit switch 15 is engaged, the switch functions to switch the mode from the lowering mode back to the lifting mode by engaging the clutch 14 such that the motor reverses movement of the vessel within the casing to again return the vessel to the upper position in the lifting mode. Once again, the upper limit switch will be engaged to switch the mode from the lifting mode back to the lowering mode so that the cycle continues in an ongoing basis.

In the lower position, the vessel is lowered to a determined depth corresponding to the vessel being submerged within hydrocarbon fluids towards the bottom of the wellbore casing. The vessel is filled with hydrocarbons in the lower position either by filling through the top opening at the open top of the vessel and/or through the bottom openings 5.

In the upper position, the vessel is positioned in close proximity to the top end of the casing for engagement with a wand member that functions to transfer the hydrocarbons collected within the production chamber of the vessel 1 to an outlet passage 11 that directs the produced hydrocarbons to a discharge location externally of the wellbore casing.

The wand member generally comprises a wand pipe 2 that is supported concentrically within the wellbore casing adjacent the top end thereof. The wand pipe has an outer diameter which is less than the inner diameter of the vessel 1 to define a radial gap between the wand pipe and the inner surface of the cylindrical wall of the vessel 1 when the wand pipe is received concentrically within the vessel.

The wand pipe 2 includes a main cylindrical wall extending about a cylindrical receiving chamber defined therein which occupies the majority of the hollow interior of the wand pipe 2. A bottom nose cone is formed at the bottom end of the wand pipe 2 in which the peripheral wall of the wand pipe tapers downwardly and inwardly to a central apex at the bottom end thereof similarly to the bottom end of the vessel 1. A plurality of bottom openings 10 are provided within the bottom nose cone portion of the wand pipe 2 referred to above as wand slots. The bottom openings 10 are circumferentially spaced apart about the apex in the bottom nose cone portion of the wand pipe.

The bottom openings 10 communicate from the exterior of the wand pipe to a common entry chamber defined within the hollow interior of the nose cone portion of the wand pipe 2. A wand check valve 9 is supported to fully span across the hollow interior of the wand pipe to directly below the receiving chamber at the top end of the entry chamber corresponding to the junction of the cylindrical main portion of the wand pipe 2 and the bottom nose cone portion of the wand pipe. The wand check valve 9 is a one-way flap valve which only opens to allow upward flow of produced fluids therethrough when the pressure below the valve exceeds the pressure above the valve.

The wand member supports a plurality of annular seals 8 at a fixed location to extend about the exterior of the wand member. The annular seals are positioned closer to the bottom end than the top end of the wand pipe 2 while remaining above the bottom openings 10. The annular seals 8 are arranged to span the radial gap between the outer diameter of the wand pipe 2 and the inner diameter of the production chamber within the hollow interior of the vessel 1. The seals remain fixed relative to the wand member but are arranged for sliding contact along the inner surface of the walls of the vessel 1 to define a sealing interface between the exterior of the wand member and the interior of the vessel which allows relative sliding therebetween.

When the vessel 1 approaches the upper position, the apex of the wand member aligns with the top opening in the bailer vessel to guide the main cylindrical portion of the wand member into the top opening of the vessel. The tapered mouth at the top opening of the vessel also assists in concentrically locating the vessel 1 about the wand member as the vessel is displaced slidably over top of the bottom end of the wand member. The annular seals 8 fit snugly between the interior diameter of the vessel and the outer diameter of the wand member so that some compression of the seals occur and so that the seals 8 are capable of preventing fluid flow across the sealing interface and are capable of holding a pressure differential across the sealing interface.

Continued lifting of the vessel 1 after initial contact of the annular seals 8 with the top of the vessel results in a volume of the production chamber within the vessel defined between the sealing interface of the annular seals 8 thereabove and the bailer check valve 6 therebelow being reduced until the vessel reaches the upper position. In the upper position, the bottom end of the wand member is in close proximity to the check valve 6 of the vessel.

The reduction in volume of the production chamber which becomes occupied by the wand pipe 2 forces hydrocarbon fluids within the production chamber under pressure into the bottom openings of the wand. The introduction of fluid under pressure into the entry chamber of the wand member causes the check valve of the wand to open to transfer fluid into the receiving chamber within the hollow interior of the wand member. Any fluids previously occupying the receiving chamber are in turn forced upwardly by the pressurized flow of fluid through an outlet at the top end of the wand member which communicates with the outlet passage 11. More particularly, the outlet passage communicates through a respective opening in the flange defining the wellhead 3 at the top end of the casing.

Continued operation of the motor of the drive assembly causes the vessel 1 to be reciprocated between the lower position submerged with hydrocarbons for filling the production chamber and the upper position receiving the wand member in the production chamber of the vessel 1 to force a flow of hydrocarbon fluids collected in the production chamber upwardly and outwardly through the wand member to the outlet passage 11 to a discharge location externally of the casing, such as a production storage tank.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A wellbore production system for use with a wellbore having a casing containing hydrocarbon fluids, the system comprising:

a bailer vessel arranged to be received in the casing of the wellbore so as to be movable longitudinally along the casing between an upper position in proximity to a top end of the casing and a lower position arranged to be submerged in the hydrocarbon fluids at a predetermined depth within the casing;

the bailer vessel comprising (i) a production chamber, (ii) at least one bottom opening in communication with a bottom of the production chamber and arranged to receive the hydrocarbon fluids into the production chamber therethrough in the lower position of the bailer vessel, (iii) a bailer valve associated with said at least one bottom opening so as to be arranged to restrict removal of fluids from the production chamber through the at least one bottom opening when the bailer vessel is not in the lower position, and (iv) a top opening in communication with a top of the production chamber;

a lift assembly operatively connected to the bailer vessel through the top end of the casing and arranged to displace the bailer vessel between the upper position and the lower position thereof;

a wand member arranged to be supported within the casing in proximity to the top end of the casing such that a bottom end of the wand member is arranged to be received into the production chamber through the top opening of the bailer vessel in the upper position of the bailer vessel;

the wand member including (i) a receiving chamber, (ii) at least one bottom opening in communication with a bottom of the receiving chamber and arranged to receive the hydrocarbon fluids into the receiving chamber therethrough as the bailer vessel approaches the upper position and receives the bottom end of the wand member therein, (iii) a wand valve associated with said at least one bottom opening so as to be arranged to restrict removal of fluids from the receiving chamber through the at least one bottom opening when the bailer vessel is not in the upper position, and (iv) an outlet opening in communication with the receiving chamber;

an outlet passage arranged to communicate from the outlet opening of the wand member to a discharge location externally of the casing; and a sealing interface between the wand member and the bailer vessel which seals the top of the production chamber in the bailer vessel closed when the wand member is received within the bailer vessel, the sealing interface being arranged to maintain a seal between the wand member and the bailer vessel throughout relative sliding movement between the wand member and the bailer vessel when the bailer vessel is in proximity to the upper position.

2. The system according to claim 1 wherein a contained volume of the production chamber between the bailer valve therebelow and the sealing interface thereabove is reduced as the bailer vessel approaches the upper position to force the hydrocarbons in the production chamber of the bailer vessel to enter the at least one bottom opening of the wand member under pressure.

3. The system according to claim 1 wherein the sealing interface comprises a sealing member fixedly supported on an exterior of the wand member so as to be slidable along an interior surface of the bailer vessel as the bailer vessel approaches the upper position.

4. The system according to claim 3 wherein the sealing member is supported in proximity to the bottom of the receiving chamber above said at least one bottom opening in the wand member.

5. The system according to claim 1 wherein the bailer valve comprises a check valve which only allows hydrocarbon fluids to enter the production chamber through the at least one bottom opening of the bailer vessel.

6. The system according to claim 1 wherein the wand valve comprises a check valve which only allows hydrocarbon fluids to enter the receiving chamber through the at least one bottom opening of the wand member.

7. The system according to claim 1 wherein the bailer vessel includes a bottom end which is tapered downwardly and inwardly towards a pointed apex.

8. The system according to claim 1 wherein said at least one bottom opening in the wand member comprises a plurality of bottom openings.

9. The system according to claim 8 wherein a bottom end of the wand member is tapered downwardly and inwardly towards a pointed apex and the plurality of bottom openings of the wand member are circumferentially spaced apart about the pointed apex of the wand member.

10. The system according to claim 8 wherein the wand valve comprises a single valve operatively connected to the plurality of bottom openings of the wand member.

11. The system according to claim 1 wherein the lift assembly comprises a winch assembly suspending the bailer vessel from a winch cable, the winch assembly being arranged to lower the bailer vessel from the upper position to the lower position under force of gravity using hydraulic restriction to limit rate of decent of the bailer vessel within the casing.

12. A wellbore production system for use with a wellbore having a casing containing hydrocarbon fluids, the system comprising:

a bailer vessel arranged to be received in the casing of the wellbore so as to be movable longitudinally along the casing between an upper position in proximity to a top end of the casing and a lower position arranged to be submerged in the hydrocarbon fluids at a predetermined depth within the casing;

the bailer vessel comprising (i) a production chamber, (ii) at least one bottom opening in communication with a bottom of the production chamber and arranged to receive the hydrocarbon fluids into the production chamber therethrough in the lower position of the bailer vessel, (iii) a bailer valve associated with said at least one bottom opening so as to be arranged to restrict removal of fluids from the production chamber through the at least one bottom opening when the bailer vessel is not in the lower position, and (iv) a top opening in communication with a top of the production chamber;

a lift assembly operatively connected to the bailer vessel through the top end of the casing and arranged to displace the bailer vessel between the upper position and the lower position thereof;

a wand member arranged to be supported within the casing in proximity to the top end of the casing such that a bottom end of the wand member is arranged to be received into the production chamber through the top opening of the bailer vessel in the upper position of the bailer vessel;

the wand member including (i) a receiving chamber, (ii) at least one bottom opening in communication with a bottom of the receiving chamber and arranged to receive the hydrocarbon fluids into the receiving chamber therethrough as the bailer vessel approaches the upper position and receives the bottom end of the wand member therein, (iii) a wand valve associated with said at least one bottom opening so as to be arranged to restrict removal of fluids from the receiving chamber through the at least one bottom opening when the bailer vessel is not in the upper position, and (iv) an outlet opening in communication with the receiving chamber; and an outlet passage arranged to communicate from the outlet opening of the wand member to a discharge location externally of the casing;

wherein said at least one bottom opening in the bailer vessel comprises a plurality of bottom openings.

13. The system according to claim 12 wherein a bottom end of the bailer vessel is tapered downwardly and inwardly towards a pointed apex and the plurality of bottom openings are circumferentially spaced apart about the pointed apex.

14. The system according to claim 12 wherein the bailer valve comprises a single valve operatively connected to the plurality of bottom openings of the bailer vessel.

15. A wellbore production system for use with a wellbore having a casing containing hydrocarbon fluids, the system comprising:

a bailer vessel arranged to be received in the casing of the wellbore so as to be movable longitudinally along the casing between an upper position in proximity to a top end of the casing and a lower position arranged to be submerged in the hydrocarbon fluids at a predetermined depth within the casing;

the bailer vessel comprising (i) a production chamber, (ii) at least one bottom opening in communication with a bottom of the production chamber and arranged to receive the hydrocarbon fluids into the production chamber therethrough in the lower position of the bailer vessel, (iii) a bailer valve associated with said at least one bottom opening so as to be arranged to restrict removal of fluids from the production chamber through the at least one bottom opening when the bailer vessel is not in the lower position, and (iv) a top opening in communication with a top of the production chamber;

a lift assembly operatively connected to the bailer vessel through the top end of the casing and arranged to displace the bailer vessel between the upper position and the lower position thereof;

a wand member arranged to be supported within the casing in proximity to the top end of the casing such that a bottom end of the wand member is arranged to be received into the production chamber through the top opening of the bailer vessel in the upper position of the bailer vessel;

the wand member including (i) a receiving chamber, (ii) at least one bottom opening in communication with a bottom of the receiving chamber and arranged to receive the hydrocarbon fluids into the receiving chamber therethrough as the bailer vessel approaches the upper position and receives the bottom end of the wand member therein, (iii) a wand valve associated with said at least one bottom opening so as to be arranged to restrict removal of fluids from the receiving chamber through the at least one bottom opening when the bailer vessel is not in the upper position, and (iv) an outlet opening in communication with the receiving chamber;

an outlet passage arranged to communicate from the outlet opening of the wand member to a discharge location externally of the casing; and a wellhead enclosing a top end of the casing, wherein the outlet passage communicates externally of the casing through the wellhead.

16. A wellbore production system for use with a wellbore having a casing containing hydrocarbon fluids, the system comprising:

a bailer vessel arranged to be received in the casing of the wellbore so as to be movable longitudinally along the casing between an upper position in proximity to a top end of the casing and a lower position arranged to be submerged in the hydrocarbon fluids at a predetermined depth within the casing;

the bailer vessel comprising (i) a production chamber, (ii) at least one bottom opening in communication with a bottom of the production chamber and arranged to receive the hydrocarbon fluids into the production chamber therethrough in the lower position of the bailer vessel, (iii) a bailer valve associated with said at least one bottom opening so as to be arranged to restrict removal of fluids from the production chamber through the at least one bottom opening when the bailer vessel is not in the lower position, and (iv) a top opening in communication with a top of the production chamber;

a lift assembly operatively connected to the bailer vessel through the top end of the casing and arranged to displace the bailer vessel between the upper position and the lower position thereof;

a wand member arranged to be supported within the casing in proximity to the top end of the casing such that a bottom end of the wand member is arranged to be received into the production chamber through the top opening of the bailer vessel in the upper position of the bailer vessel;

the wand member including (i) a receiving chamber, (ii) at least one bottom opening in communication with a bottom of the receiving chamber and arranged to receive the hydrocarbon fluids into the receiving chamber therethrough as the bailer vessel approaches the upper position and receives the bottom end of the wand member therein, (iii) a wand valve associated with said at least one bottom opening so as to be arranged to restrict removal of fluids from the receiving chamber through the at least one bottom opening when the bailer vessel is not in the upper position, and (iv) an outlet opening in communication with the receiving chamber;

an outlet passage arranged to communicate from the outlet opening of the wand member to a discharge location externally of the casing; and a wellhead enclosing a top end of the casing, wherein the lift assembly comprises a winch assembly having a winch cable communicating into the casing through a cable stripper mounted in the wellhead.

17. The system according to claim 16 wherein the winch cable communicates through the wellhead at an offset location adjacent a periphery of the casing and attaches to the bailer vessel offset to one side of the bailer vessel.

18. A wellbore production system for use with a wellbore having a casing containing hydrocarbon fluids, the system comprising:

a bailer vessel arranged to be received in the casing of the wellbore so as to be movable longitudinally along the casing between an upper position in proximity to a top end of the casing and a lower position arranged to be submerged in the hydrocarbon fluids at a predetermined depth within the casing;

the bailer vessel comprising (i) a production chamber, (ii) at least one bottom opening in communication with a bottom of the production chamber and arranged to receive the hydrocarbon fluids into the production chamber therethrough in the lower position of the bailer vessel, (iii) a bailer valve associated with said at least one bottom opening so as to be arranged to restrict removal of fluids from the production chamber through the at least one bottom opening when the bailer vessel is not in the lower position, and (iv) a top opening in communication with a top of the production chamber;

a lift assembly operatively connected to the bailer vessel through the top end of the casing and arranged to displace the bailer vessel between the upper position and the lower position thereof;

a wand member arranged to be supported within the casing in proximity to the top end of the casing such that a bottom end of the wand member is arranged to be received into the production chamber through the top opening of the bailer vessel in the upper position of the bailer vessel;

the wand member including (i) a receiving chamber, (ii) at least one bottom opening in communication with a bottom of the receiving chamber and arranged to receive the hydrocarbon fluids into the receiving chamber therethrough as the bailer vessel approaches the upper position and receives the bottom end of the wand member therein, (iii) a wand valve associated with said at least one bottom opening so as to be arranged to restrict removal of fluids from the receiving chamber through the at least one bottom opening when the bailer vessel is not in the upper position, and (iv) an outlet opening in communication with the receiving chamber; and an outlet passage arranged to communicate from the outlet opening of the wand member to a discharge location externally of the casing;

wherein the lift assembly includes a drive assembly operable in a lifting mode to raise the bailer vessel up to the upper position and in a lowering mode to lower the bailer vessel down to the lower portion, the drive assembly comprising:

a screw rod which is (i) rotated in a first direction of rotation in the lifting mode and (ii) rotated in an opposing second direction of rotation in the lowering mode;

a follower element operatively connected to the screw rod such that the follower element is (i) displaced along the screw rod in a first direction when the screw rod is rotated in the first direction of rotation and (ii) displaced along the screw rod in an opposing second direction when the screw rod is rotated in an opposing second direction of rotation corresponding to lowering of the bailer vessel within the casing;

an upper limit switch arranged to be actuated by the follower element when the bailer vessel reaches the upper position and which is operable to switch operation of the drive assembly from the lifting mode to the lowering mode; and a lower limit switch arranged to be actuated by the follower element when the bailer vessel reaches the lower position and which is operable to switch operation of the drive assembly from the lowering mode to the lifting mode.

* * * * *